US011393407B2

(12) United States Patent
Kim et al.

(10) Patent No.: US 11,393,407 B2
(45) Date of Patent: Jul. 19, 2022

(54) DISPLAY DRIVER IC AND ELECTRONIC APPARATUS INCLUDING THE SAME

(71) Applicant: SAMSUNG ELECTRONICS CO., LTD., Suwon-si (KR)

(72) Inventors: In-Suk Kim, Suwon-si (KR); Jungmoon Kim, Namyangju-si (KR); Woo-Nyoung Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/108,141

(22) Filed: Dec. 1, 2020

(65) Prior Publication Data

US 2021/0366405 A1 Nov. 25, 2021

(30) Foreign Application Priority Data

May 20, 2020 (KR) ..... 10-2020-0060345

(51) Int. Cl.
*G09G 3/3275* (2016.01)
*G09G 3/20* (2006.01)
*G09G 3/36* (2006.01)

(52) U.S. Cl.
CPC ..... *G09G 3/3275* (2013.01); *G09G 3/2003* (2013.01); *G09G 3/3685* (2013.01); *G09G 3/3688* (2013.01); *G09G 3/3696* (2013.01); *G09G 2310/027* (2013.01); *G09G 2310/0291* (2013.01); *G09G 2320/0673* (2013.01); *G09G 2330/028* (2013.01)

(58) Field of Classification Search
CPC ..... G09G 3/3275; G09G 3/2003; G09G 3/3685; G09G 3/3688; G09G 3/3696; G09G 2310/027; G09G 2310/0291; G09G 2320/0673; G09G 2330/028
See application file for complete search history.

(56) References Cited

U.S. PATENT DOCUMENTS

| | | | | |
|---|---|---|---|---|
| 7,903,069 | B2 * | 3/2011 | Kwon | G09G 3/3688 345/98 |
| 8,823,753 | B2 | 9/2014 | Kim et al. | |
| 9,558,708 | B2 | 1/2017 | Ura et al. | |
| 10,078,980 | B2 * | 9/2018 | Kong | G09G 3/2003 |
| 10,176,747 | B2 | 1/2019 | Hasegawa et al. | |
| 10,199,005 | B2 * | 2/2019 | Kong | G09G 3/3607 |

(Continued)

FOREIGN PATENT DOCUMENTS

JP 2013-205704 A 10/2013

*Primary Examiner* — Gene W Lee
(74) *Attorney, Agent, or Firm* — Lee IP Law, PC

(57) ABSTRACT

An electronic device includes a first source group and a second source group, each of which includes a plurality of source channels, and a gamma block that receives first to 2i-th initial voltages (i being an integer of 1 or more), outputs first to 2i-th intermediate voltages by amplifying the first to i-th initial voltages, and outputs first to i-th gamma voltages to the first source group by buffering the first to 2i-th intermediate voltages, and a first buffer block that receives the first to 2i-th intermediate voltages from the gamma block and buffers the first to 2i-th intermediate voltages so as to be output to the second source group, and the gamma block may include a first resistor string including a plurality of resistors connected between nodes from which the first to i-th gamma voltages are output.

20 Claims, 14 Drawing Sheets

(56) References Cited

U.S. PATENT DOCUMENTS

| | | | | |
|---|---|---|---|---|
| 2007/0140014 | A1* | 6/2007 | Kwon | G09G 3/3688<br>365/185.22 |
| 2007/0182683 | A1 | 8/2007 | Chin et al. | |
| 2010/0020114 | A1 | 1/2010 | Lee et al. | |
| 2017/0098404 | A1 | 4/2017 | Lee et al. | |
| 2019/0340996 | A1* | 11/2019 | Kim | G09G 3/3696 |

* cited by examiner

DISPLAY DRIVER IC AND ELECTRONIC APPARATUS INCLUDING THE SAME

CROSS-REFERENCE TO RELATED APPLICATION

Korean Patent Application No. 10-2020-0060345, filed on May 20, 2020, in the Korean Intellectual Property Office, and entitled: "Display Driver IC and Electronic Apparatus Including the Same," is incorporated by reference herein in its entirety.

BACKGROUND

1. Field

Embodiments relate to a display driver integrated circuit (IC) and an electronic device including the same.

2. Description of the Related Art

An electronic device includes a display driver integrated circuit (DDI) for displaying image data in a display panel. The display driver IC includes a source driver that provides input data signals associated with image data to a plurality of pixels included in the display panel through source lines. The source driver includes source channels respectively connected to the source lines. One source channel includes a source decoder that select one of a plurality of gamma voltages generated by a gamma voltage generator based on an input data signal and a source amplifier that amplifies or buffers the selected voltage to a relevant pixel within a given time.

SUMMARY

Embodiments are directed to an electronic device, including a first source group and a second source group each including a plurality of source channels; a gamma block configured to receive first to 2i-th initial voltages wherein i is an integer of 1 or more, to output first to 2i-th intermediate voltages by amplifying the first to i-th initial voltages, and to output first to i-th gamma voltages to the first source group by buffering the first to 2i-th intermediate voltages; and a first buffer block configured to receive the first to 2i-th intermediate voltages from the gamma block and to buffer the first to 2i-th intermediate voltages so as to be output to the second source group. The gamma block may include a first resistor string including a plurality of resistors connected between nodes from which the first to i-th gamma voltages are output.

Embodiments are also directed to an electronic device, including a display panel including a plurality of pixels; and a display driver integrated circuit. The display driver integrated circuit may include a gate driver connected with the plurality of pixels through first to m-th gate lines, and configured to activate the first to m-th gate lines; a source driver connected to the plurality of pixels through first to n-th source lines, and configured to provide data signals to the first to n-th source lines respectively; and a gamma voltage generator configured to generate first to i-th gamma voltages wherein i is an integer more than 1, and to provide the first to i-th gamma voltages to the source driver. Each of the data signals may be based on the first to i-th gamma voltages. The gamma voltage generator may include first to i-th gamma voltage amplifiers configured to respectively receive first to i-th initial voltages, to respectively output first to 2i-th intermediate voltages by respectively amplifying the first to i-th initial voltages, and to respectively output the first to i-th gamma voltages by respectively buffering the first to i-th intermediate voltages; and a first resistor string including a plurality of resistors connected between nodes of the first to i-th gamma voltage amplifiers from which the first to i-th gamma voltages are output.

Embodiments are also directed to an electronic device, including a gamma block configured to generate gamma voltages; first source channels disposed on one side of the gamma block in a first direction, and configured to receive the gamma voltages and to output first gamma voltages selected from the gamma voltages to first source lines; second source channels disposed on another side of the gamma block in a second direction facing away from the first direction, and configured to receive the gamma voltages and to output second gamma voltages selected from the gamma voltages to second source lines; a first buffer block disposed on one side of the first source channels in the first direction, and configured to supply first buffering voltages corresponding to the gamma voltages to the first source channels; and a second buffer block disposed on one side of the second source channels in the second direction, and configured to supply second buffering voltages corresponding to the gamma voltages to the second source channels.

BRIEF DESCRIPTION OF THE DRAWINGS

Features will become apparent to those of skill in the art by describing in detail example embodiments with reference to the attached drawings in which.

DETAILED DESCRIPTION

Figure 1:
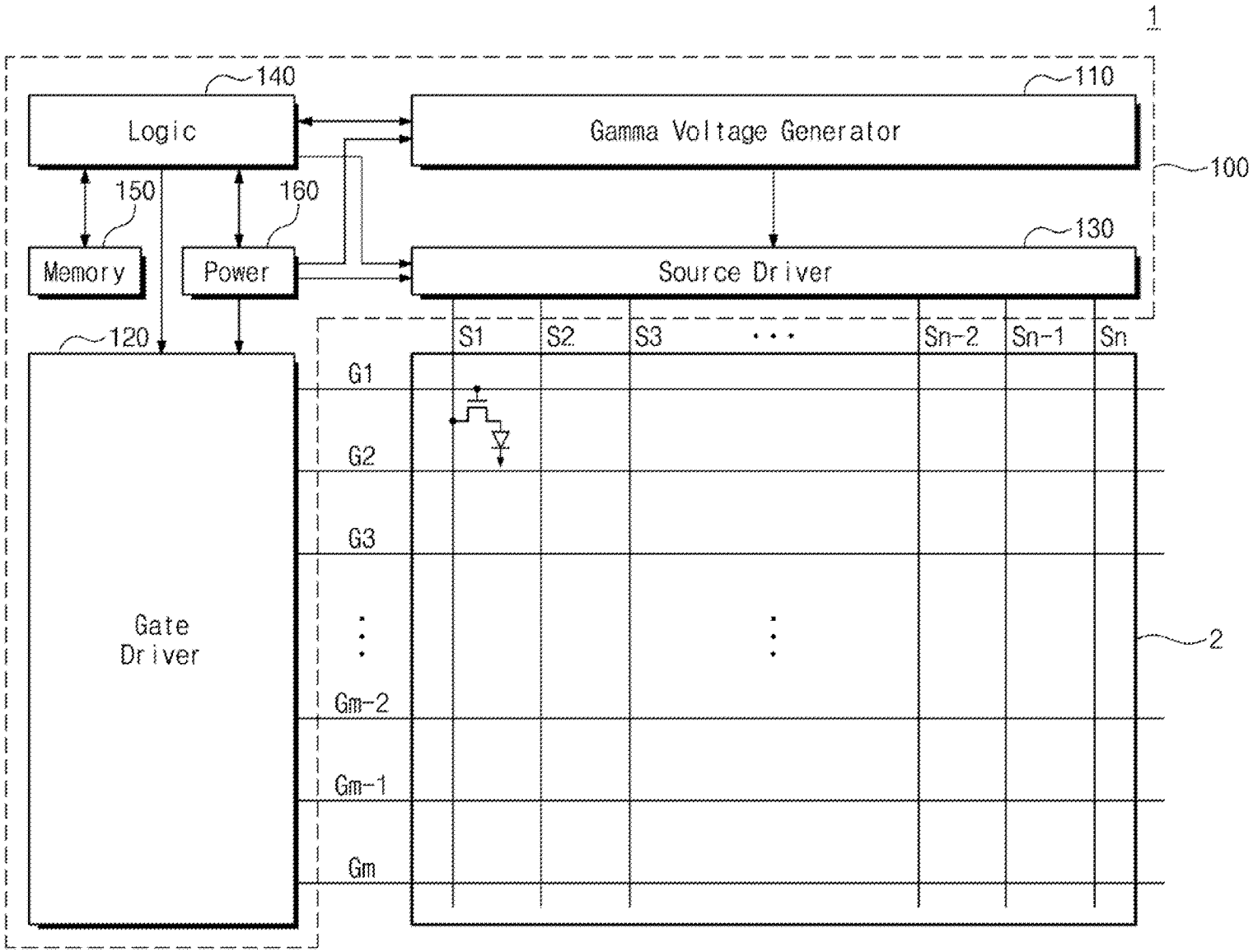
FIG. 1 illustrates a block diagram of an electronic device according to an example embodiment.

FIG. 1 illustrates a block diagram of an electronic device according to an example embodiment.

Referring to FIG. 1, an electronic device 1 according to an example embodiment may include a display driver IC (DDI) 100 and a display panel 2. The electronic device 1 may be included, for example, in a portable communication terminal such as a smartphone, a small-sized electronic device such as a personal digital assistant (PDA), a portable media player (PMP), a wearable device, a camera, a portable game console, an e-book reader, or a tablet PC, or a large-sized electronic product such as a television or a monitor.

The DDI 100 may include a gamma voltage generator 110, a gate driver 120, a source driver 130, a logic block 140, a memory 150, and a power block 160. For example, all or a part of the gamma voltage generator 110, the gate driver 120, the source driver 130, the logic block 140, the memory 150, and the power block 160 may be implemented with the same semiconductor die, chip, or module. For another example, the gamma voltage generator 110, the gate driver 120, the source driver 130, the logic block 140, the memory 150, and the power block 160 may be implemented with separate semiconductor dies, chips, or modules, respectively. For another example, the gate driver 120 and the source driver 130 may be implemented on the same substrate as the display panel 2. In this case, the gate driver 120 and the source driver 130 may be disposed on an outer portion (or at a periphery) of the display panel 2.

The electronic device 1 may receive image data from another component (e.g., an application processor (AP)) of an electronic device in which the electronic device 1 is included. The electronic device 1 may display the received image data or an image corresponding to the received image data through the plurality of pixels of the display panel 2.

The display panel 2 may include a plurality of pixels. Each of the plurality of pixels may be connected to a corresponding one of gate lines G1 to Gm and a corresponding one of source lines S1 to Sn. Each of the plurality of pixels may display image information corresponding to voltages or signals of the corresponding gate line and the corresponding source lines. Each of the plurality of pixels may display one of a plurality of colors. For example, one pixel may display one of a red, a green, or a blue. Below, a pixel displaying the red is referred to as an "R pixel", a pixel displaying the green is referred to as a "G pixel", and a pixel displaying the blue is referred to as a "B pixel".

In an example embodiment, the display panel 2 may be implemented with an organic light emitting diode (OLED) display panel. In this case, each of the plurality of pixels may include a transistor and a diode as illustrated in FIG. 1. For example, a gate terminal of the transistor may be connected to one of the gate lines G1 to Gm. A drain terminal of the transistor may be connected to one of the source lines S1 to Sn. A source terminal of the transistor may be connected to a diode.

In another example embodiment, the display panel 2 may be implemented with various kinds of display panels including a liquid crystal display (LED) panel. In this case, the plurality of pixels may further include any other elements (or components) not illustrated in FIG. 1. For example, in the case where the display panel 2 is implemented with an LED panel, unlike the example illustrated in FIG. 1, each of the plurality of pixels may include a liquid crystal instead of a diode. In this case, the electronic device 1 may further include other component(s) such as a backlight (not illustrated).

The gamma voltage generator 110 may generate a plurality of gamma voltages (or gamma tap voltages) (e.g., VG1 to VGi of FIG. 4, described below) and may provide the plurality of gamma voltages to the source driver 130. The gamma voltage generator 110 may generate the plurality of gamma voltages respectively corresponding to various levels of luminance. The plurality of gamma voltages may be provided to a plurality of pixels through the source lines S1 to Sn. The number of gamma voltages generated by the gamma voltage generator 110 may be determined based on the number of colors to be displayed through the display panel 2 or the number of bits of digital data provided from the outside of the electronic device 1. For example, in the case where the number of bits of the digital data is "j" (j being a positive integer), the number of gamma voltages generated by the gamma voltage generator 110 may be $2^j$ or less.

Levels of the plurality of gamma voltages may be determined based on a gamma curve corresponding to each of colors to be displayed by pixels. In this case, gamma curves respectively corresponding to the colors may be different.

The gate driver 120 may control the gate lines G1 to Gm. For example, the gate driver 120 may sequentially provide gate signals to the gate lines G1 to Gm. A gate signal may be a signal for activating a plurality of pixels connected to a gate line corresponding to the gate signal.

The source driver 130 may provide image information to be displayed to a plurality of pixels through the source lines S1 to Sn. The source driver 130 may receive the plurality of gamma voltages from the gamma voltage generator 110. The source driver 130 may select one of the plurality of gamma voltages, based on image information to be displayed. The source driver 130 may provide the selected gamma voltage to one of the plurality of pixels, based on the image information to be displayed.

As described above, image data (or an image corresponding to the image data) applied from the outside of the electronic device 1 may be displayed in the display panel 2 by the gate driver 120 and the source driver 130. In detail, the gate driver 120 may provide a gate signal to the first gate line G1. While the gate signal is being provided to the first gate line G1, the source driver 130 may provide gamma voltages corresponding to the image data from among the plurality of gamma voltages to a plurality of pixels connected to the source lines S1 to Sn. As such, pixels connected to the first gate line G1 may display a portion of the image data. As described above, the gate driver 120 may sequentially provide gate signals to the second to m-th gate lines G2 to Gm (m being a positive integer). As such, the image data applied from the outside of the electronic device 1 may be displayed in the display panel 2.

The logic block 140 may receive image data (to be displayed in the display panel 2) from the outside of the electronic device 1. The logic block 140 may control the gamma voltage generator 110, the gate driver 120, the source driver 130, the memory 150, and the power block 160.

The logic block 140 may include, for example, a timing controller that controls the gate driver 120 and the source driver 130 such that each of the plurality of pixels included in the display panel 2 displays the corresponding image information. The timing controller may generate various signals (e.g., a gate signal and a switch control signal SWC (refer to FIG. 3C)) for controlling the gate driver 120 and the source driver 130. A scan rate of the display panel 2 may be determined by the signals generated by the timing controller.

For another example, the logic block 140 may provide the gamma voltage generator 110 with data associated with a gamma curve for generating a plurality of gamma voltages. In this case, pieces of data of a gamma curve for generating a plurality of gamma voltages respectively provided to pixels displaying different colors may be different.

The memory 150 may be also referred to as a "graphic memory" or a "graphic random access memory (GRAM)". The memory 150 may receive data to be output through the source driver 130 from the logic block 140 and may store the received data. For example, the logic block 140 may receive image data (to be displayed in the display panel 2) from the outside of the electronic device 1 and may provide the received image data to the memory 150. The memory 150 may output the stored image data to the source driver 130 under control of the logic block 140.

For example, when a still image is displayed through the electronic device 1, the memory 150 may output the stored image data, thus preventing the electronic device 1 from continuously receiving the image data from an external device. The memory 150 may reduce power consumption of the electronic device 1 and may reduce heat generation of the electronic device 1. Unlike the example illustrated in FIG. 1, the DDI 100 may not include the memory 150, and the DDI 100 may include two or more memories (e.g., 151 and 152 of FIG. 2A).

The power block 160 may supply a power to the gamma voltage generator 110, the gate driver 120, the source driver 130, the logic block 140, and the memory 150. The power block 160 may supply a power necessary to drive the respective components of the electronic device 1.

Figure 2A:
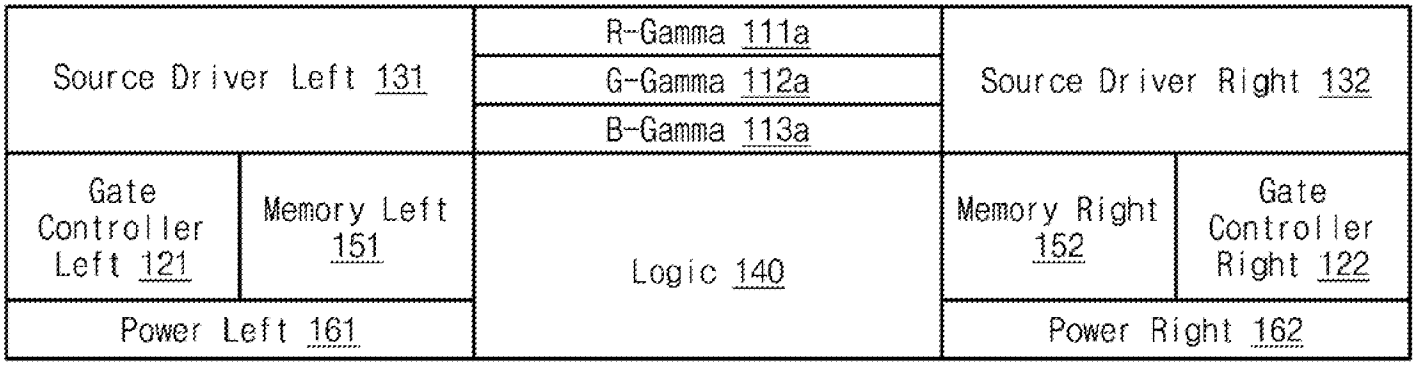
FIG. 2A is a layout diagram of components of a display driver integrated circuit of FIG. 1 according to an example embodiment.

FIG. 2A is a layout diagram of components of a display driver integrated circuit of FIG. 1 according to an example embodiment. Referring to FIGS. 1 and 2A, a DDI 100*a* of FIG. 2A may be an example of the DDI 100 of FIG. 1.

An R gamma block 111*a*, a G gamma block 112*a*, and a B gamma block 113*a* may be disposed in the middle of the DDI 100*a*. The R gamma block 111*a* may generate a plurality of gamma voltages based on a gamma curve corresponding to the red, in response to image information to be displayed. As in the above description, the G gamma block 112*a* may generate a plurality of gamma voltages based on a gamma curve corresponding to the green, and the B gamma block 113*a* may generate a plurality of gamma voltages based on a gamma curve corresponding to the blue. The gamma voltage generator 110 may include the R gamma block 111*a*, the G gamma block 112*a*, and the B gamma block 113*a*.

The source driver 130 may be divided into two groups, that is, a first source group 131 and a second source group 132, which may be disposed on opposite sides of the gamma voltage generator 110. In an example embodiment, "n" source channels (n being a positive integer more than 1) respectively connected to the source lines S1 to Sn may be halved to be disposed on opposite sides of the gamma voltage generator 110.

The logic block 140 may be disposed below the gamma blocks 111*a*, 112*a*, and 113*a*. The memories 151 and 152 may be respectively disposed adjacent to a left side and a right side of the logic block 140. The power block 160 may be divided into a plurality of power blocks 161 and 162. The power block 161 may be disposed below the memory 151 and a gate controller 121, and the power block 162 may be disposed below the memory 152 and a gate controller 122.

The gate controller 121 may be disposed adjacent to a left side of the memory 151, and the gate controller 122 may be disposed adjacent to a right side of the memory 152. The gate controllers 121 and 122 may generate pulses for generating gate signals to be output to the gate driver 120. The gate controllers 121 and 122 may provide the generated pulses to the gate driver 120. In an example embodiment, the gate driver 120 may be distributed and disposed into the gate controllers 121 and 122. The gate controllers 121 and 122 may be implemented based on a process for manufacturing transistors of the display panel 2. In an example embodiment, the gate controllers 121 and 122 may be implemented based on a low-temperature polycrystalline silicon (LTPS) process.

Figure 2B:
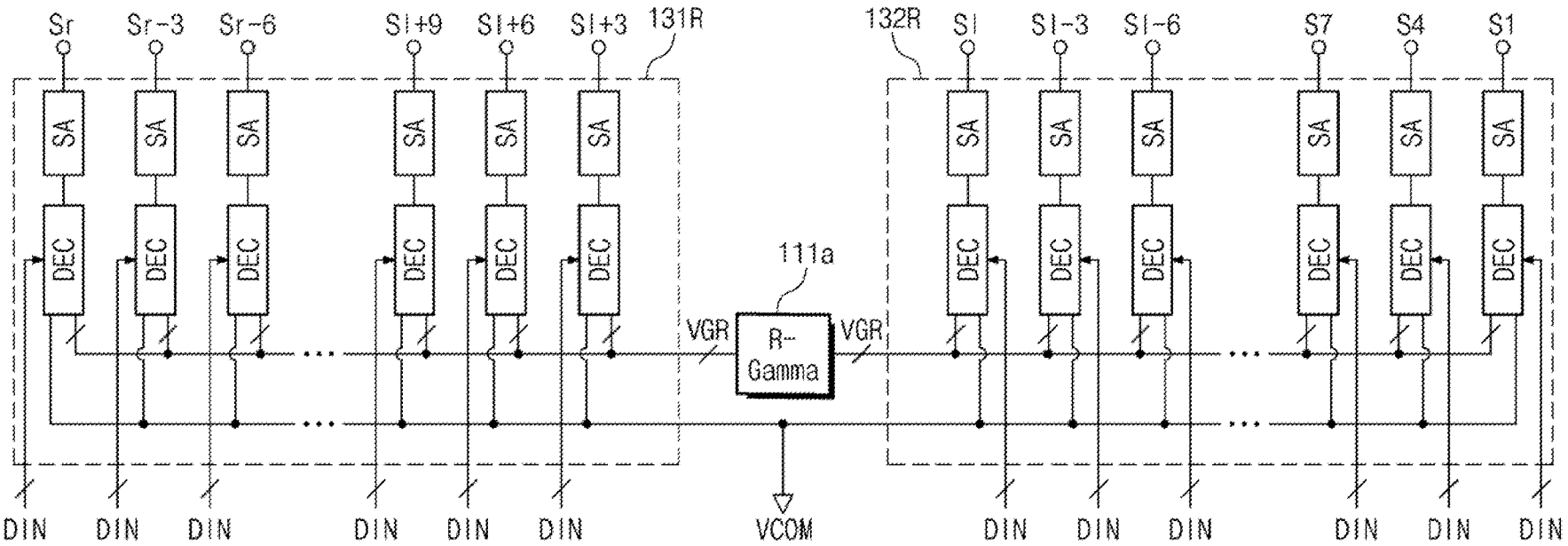
FIG. 2B illustrates a portion of a circuit diagram of a display driver integrated circuit of FIG. 2A.

FIG. 2B illustrates a portion of a circuit diagram of a display driver integrated circuit of FIG. 2A. In detail, FIG. 2B is a circuit diagram illustrating the R gamma block 111*a*, a first source group 131R, and a second source group 132R of the DDI 100*a*. The first source group 131R may be a portion of the first source group 131, and the second source group 132R may be a portion of the second source group 132.

Referring to FIGS. 1, 2A, and 2B, one source channel connected to one source line may include a source amplifier SA and a decoder DEC. The second source group 132R may include first to 1-th source lines S1 to S1 (1 being a positive integer more than 1 and smaller than n) respectively connected to first to 1-th source lines S1 to S1. The first source group 131R may include (1+3)-th to r-th source lines S1+3 to Sr (r being a positive integer more than (1+3)) respectively connected to (1+3)-th to r-th source lines S1+3 to Sr. In an example embodiment, the source lines may be divided into three fractions respectively corresponding to "R", "G", and "B" (i.e., each fraction corresponding to one third of all the source channels), and the R gamma block 111*a* may be connected to source channels (or R source channels) belonging to one corresponding to "R" from among the three fractions. In this case, the source lines S1 to Sr to which the source channels included in the first source group 131R and the second source group 132R are connected may be connected to R pixels. As in the above description, the G gamma block 112*a* may be connected to source channels (or G source channels) that belong to one corresponding to "G" from among the three fractions. In this case, the source channels connected to the G gamma block 112*a* may not be connected to the R gamma block 111*a* and the B gamma block 113*a*. The B gamma block 113*a* may be connected to source channels to which the R gamma block 111*a* and the G gamma block 112*a* are not connected, that is, source channels (or B source channels) belonging to one corresponding to "B" from among the three fractions. Thus, the R gamma block 111*a* may supply voltages to pixels of the display panel 2 corresponding to the R source channels (i.e., R pixels), the G gamma block 112*a* may supply voltages to pixels of the display panel 2 corresponding to the G source channels (i.e., G pixels), and the B gamma block 113*a* may supply voltages to pixels of the display panel 2 corresponding to the B source channels (i.e., B pixels).

The R gamma block 111*a* may be connected between the first source group 131R and the second source group 132R. The R gamma block 111*a* may generate R gamma voltages VGR to be supplied to R pixels. The R gamma block 111*a* may transmit the R gamma voltages VGR to the first source group 131R and the second source group 132R. As in the illustration of FIG. 2B, each of the G gamma block 112*a* and the B gamma block 113*a* may be connected between a portion of the first source group 131 and a portion of the second source group 132.

Each decoder DEC may receive the corresponding input data signal DIN from the logic block 140. The input data signal DIN may be a digital signal that is based on image data supplied to the electronic device 1 from the outside of the electronic device 1 to display the image data in the display panel 2. The number of R gamma voltages VGR may be determined based on the number of bits of the input data signal DIN. For example, in the case where the input data signal DIN is an 8-bit signal, the number of R gamma voltages VGR may be $2^8$, that is, 256. For another example, in the case where the input data signal DIN is a 10-bit signal, the number of R gamma voltages VGR may be 1024.

The decoder DEC may select one of the R gamma voltages VGR being an analog signal based on the received input data signal DIN being a digital signal. The decoder DEC may transmit the selected R gamma voltage to the source amplifier SA. The decoder DEC may be also referred to as a "digital-to-analog converter (DAC)" or a "multiplexer (MUX)".

The source amplifier SA may receive, from the decoder DEC, the R gamma voltage selected by the decoder DEC. The source amplifier SA may amplify (or buffer) the selected R gamma voltage, and may transmit to an R pixel in the corresponding pixel of the display panel 2 through the source line (for example, in the case where the source amplifier SA is included in the a first source channel, the first source line S1).

Each of gamma lines connecting the R gamma block 111*a* and the source channels may include a parasitic resistance (not illustrated) and a parasitic capacitance (not illustrated). As the parasitic resistance and the parasitic capacitance included in each gamma line becomes greater, a slew rate of the source amplifier SA may decrease.

Figure 3A:
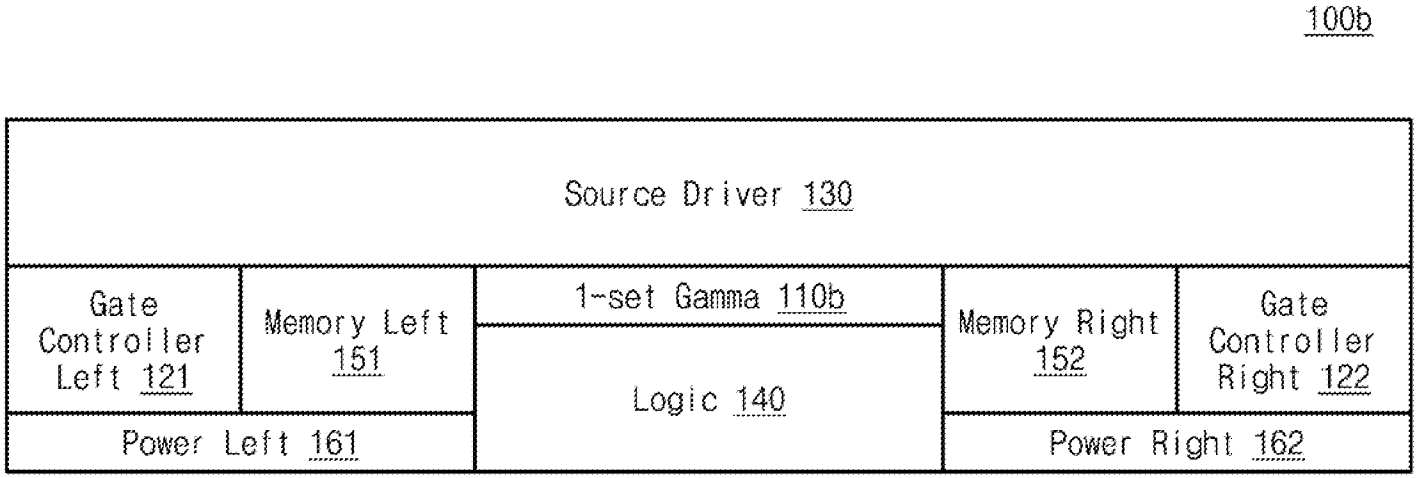
FIG. 3A is a layout diagram of components of a display driver integrated circuit of FIG. 1 according to another example embodiment.

FIG. 3A is a layout diagram of components of a display driver integrated circuit of FIG. 1 according to another example embodiment. Referring to FIGS. 1, 2A, and 3A, a DDI 100*b* may be an example of the DDI 100 of FIG. 1.

In the present example embodiment, the DDI 100*b* may include one gamma block 110*b* instead of the R gamma block 111*a*, the G gamma block 112*a*, and the B gamma block 113*a*. The gamma block 110*b* may be disposed adjacent to an upper end of the logic block 140.

In the example embodiment illustrated in FIG. 2A, the R gamma block 111*a* may generate gamma voltages to be supplied to R pixels, the G gamma block 112*a* may generate gamma voltages to be supplied to G pixels, and the B gamma block 113*a* may generate gamma voltages to be supplied to B pixels. In contrast, in the example embodiment illustrated in FIG. 3A, all the gamma voltages to be supplied to the R pixels, the G pixels, and the B pixels may be generated by the gamma block 110*b*. An area or a height of the gamma block 110*b* may be smaller than a sum of areas or heights of the R gamma block 111*a*, the G gamma block 112*a*, and the B gamma block 113*a*. The gamma block 110*b* may include the gamma voltage generator 110.

Unlike the example of FIG. 2A, the source driver 130 may be disposed above the gamma block 110*b*, the memories 151 and 152, and the gate controllers 121 and 122. In another example embodiment (not illustrated), unlike the example of FIG. 3A and as in the example of FIG. 2A, the source driver 130 may be divided into a plurality of source groups (e.g., 131 and 132) so as to be disposed adjacent to a left side and a right side of the gamma block 110*b*.

Figure 3B:
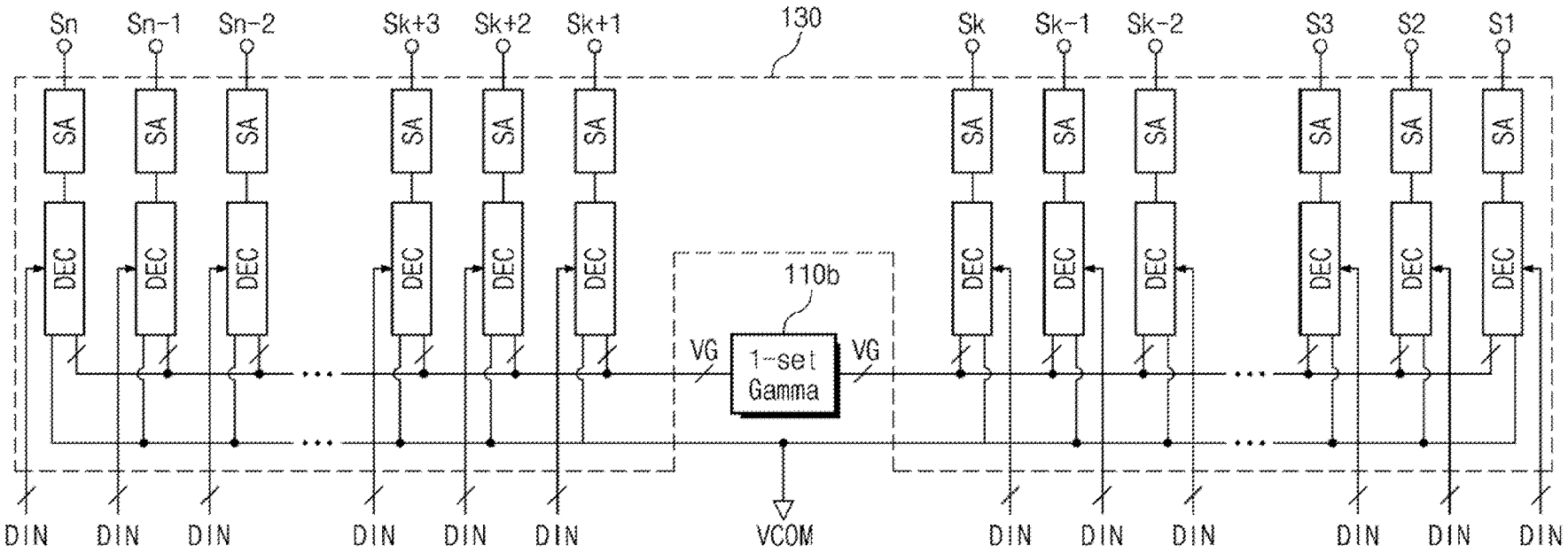
FIG. 3B illustrates a portion of a circuit diagram of a display driver integrated circuit of FIG. 3A.

FIG. 3B illustrates a portion of a circuit diagram of a display driver integrated circuit of FIG. 3A. In detail, FIG. 3B illustrates a circuit diagram including the gamma block 110*b* of the DDI 100*b* and the source driver 130 of the DDI 100*b*.

Referring to FIGS. 1, 2A, 2B, 3A, and 3B, the gamma block 110*b* may generate a plurality of gamma voltages VG. The gamma block 110*b* may provide the plurality of gamma voltages VG to the source driver 130. Unlike the R gamma voltages VGR, the gamma voltages VG may be provided to pixels displaying the read, pixels displaying the green, and pixels displaying the blue at different times (i.e., in a time-division manner).

Unlike the R gamma block 111*a*, the gamma block 110*b* may be connected to all the source channels. Thus, the number of source channels to which the gamma block 110*b* is connected may be three times the number of source channels to which the R gamma block 111*a* is connected. As such, the number (or a magnitude) of parasitic resistances and parasitic capacitances included in gamma lines connected between the gamma block 110*b* and source channels may be three times the number (or a magnitude) of parasitic resistances and parasitic capacitances included in gamma lines connected between the R gamma block 111*a* and source channels. As such, a gamma settling time (or a time constant or a delay time) in the source amplifier SA of the gamma block 110*b* may increase. Also, a slew rate of the source amplifier SA of FIG. 3B may decrease.

As a distance of the source amplifier SA from the gamma block 110*b* increases, the slew rate may further decrease. For example, a decrease in a slew rate of an n-th source amplifier connected to the n-th source line Sn and disposed relatively distant from the gamma block 110*b* may be greater than a decrease in a slew rate of the (k+1)-th source amplifier connected to the (k+1)-th source line Sk+1 and disposed adjacent to the gamma block 110*b*. As such, the performance of the DDI 100*b* may decrease.

An operation and a structure of the decoder DEC of FIG. 3B may be similar to the operation and the structure of the decoder DEC of FIG. 2B. For example, the decoder DEC of FIG. 3B may select one of the plurality of gamma voltages VG based on the input data signal DIN. The decoder DEC may provide the selected gamma voltage to the source amplifier SA.

An operation and a structure of the source amplifier SA of FIG. 3B may be similar to the operation and the structure of the source amplifier SA of FIG. 2B. For example, the source amplifier SA of FIG. 3B may receive, from the decoder DEC, the gamma voltage selected by the decoder DEC. The source amplifier SA may amplify the selected gamma voltage and may output the amplified gamma voltage to the corresponding source line (for example, in the case where the source amplifier SA is included in the first source channel, the first source line S1).

Figure 3C:
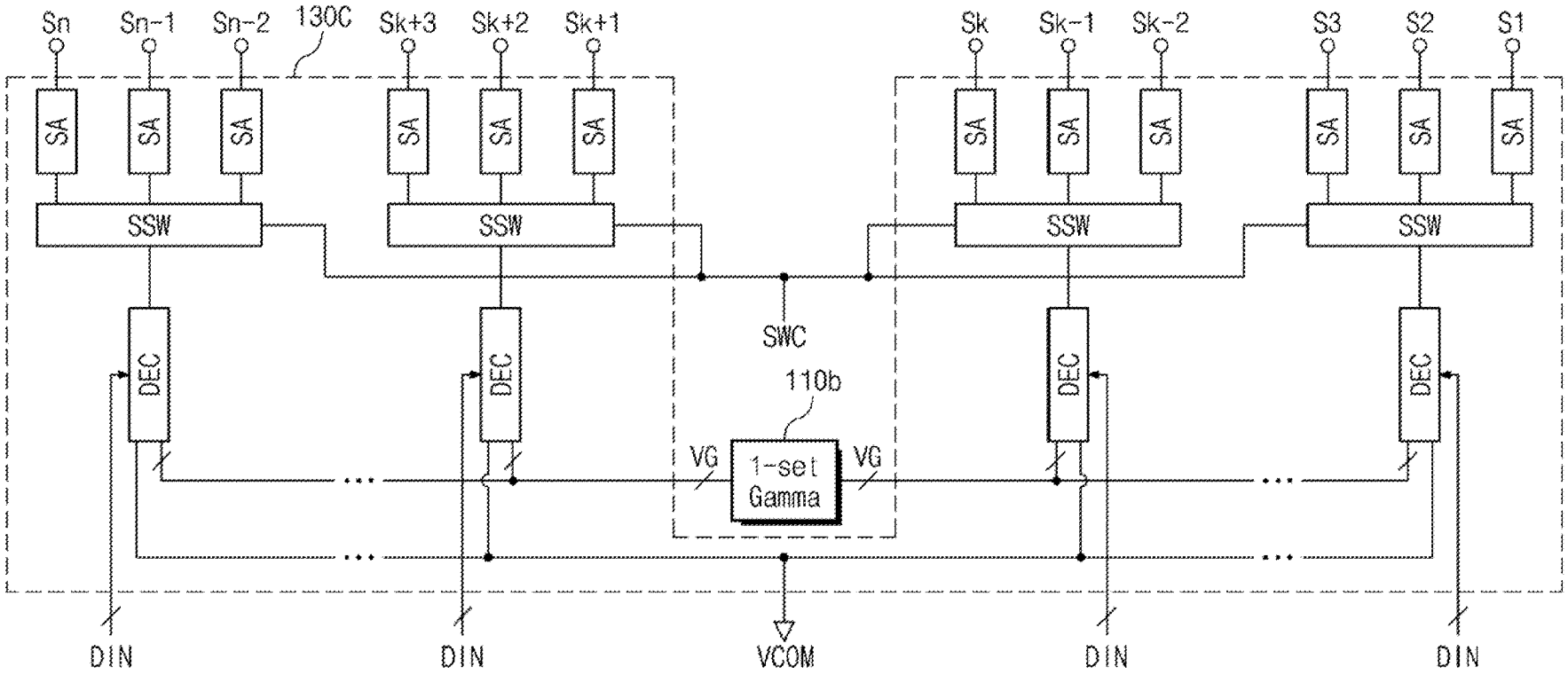
FIG. 3C illustrates a portion of a circuit diagram of a display driver integrated circuit of FIG. 3A.

FIG. 3C illustrates a portion of a circuit diagram of a display driver integrated circuit of FIG. 3A. In detail, FIG. 3C illustrates a circuit diagram including the gamma block 110*b* of the DDI 100*b*, the source driver 130, and a plurality of switches SSW.

Referring to FIGS. 1, 2A, 2B, 3A, 3B, and 3C, unlike the source amplifier SA of FIG. 3B, the source amplifier SA of FIG. 3C may output a gamma voltage selected in a time-division manner. In an example embodiment, the number of decoders DEC of FIG. 3C may be ⅓ of the number of decoders DEC of FIG. 3B. One decoder DEC may be connected to three source amplifiers SA through the switch SSW. Thus, the switch SSW may be further connected between the source amplifier SA and the decoder DEC. The switch SSW may connect only some of the source amplifiers SA to corresponding source lines under control of the logic block 140.

In an example embodiment, first to third pixels connected to the first to third source lines S1 to S3 may display the read, the green, and the blue, respectively. The first to third pixels may be connected to the first gate line G1. While the gate signal is being applied to the first gate line G1 from the gate driver 120, the switch SSW may respectively connect first to third source amplifiers SA respectively included in first to third source channels with the first to third source lines S1 to S3 during different time intervals.

For example, a time interval where the gate signal is applied to the first gate line G1 may be divided into first to third sub-time intervals. The input data signals DIN transmitted to the decoder DEC from the logic block 140 in the first to third sub-time intervals may be different.

In the first sub-time interval, the input data signal DIN may be associated with image data to be displayed by a first pixel. The decoder DEC may select one of the plurality of gamma voltages VG based on the input data signal DIN. The decoder DEC may transmit the selected gamma voltage to the switch SSW. The switch SSW may receive a switch control signal SWC from the logic block 140. In response to the switch control signal SWC, the switch SSW may connect the first source amplifier SA with the first source line S1, and may disconnect the second and third source amplifiers SA from the second and third source lines S2 and S3. The switch SSW may transmit the gamma voltage selected by the decoder DEC to the first source amplifier SA.

As in the above description, in the second sub-time interval, the switch SSW may connect the second source amplifier SA with the second source line S2 and may disconnect the first and third source amplifiers SA with the first and third source lines S1 and S3. In the third sub-time interval, the switch SSW may connect the third source amplifier SA with the third source line S3 and may disconnect the first and second source amplifiers SA with the first and second source lines S1 and S2.

Figure 4:
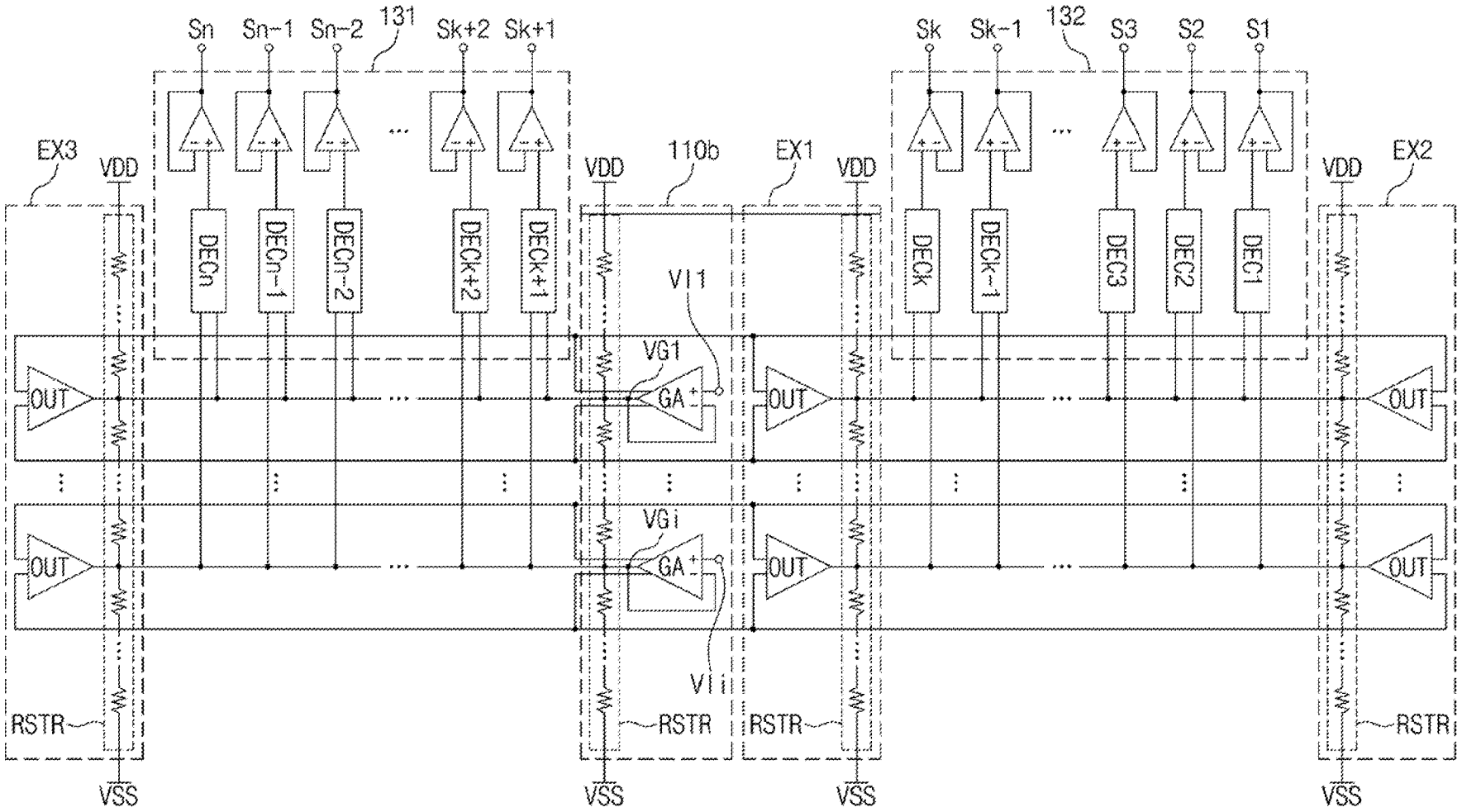
FIG. 4 illustrates a portion of a circuit diagram of a display driver integrated circuit of FIG. 3A according to another example embodiment in detail.

FIG. 4 illustrates a portion of a circuit diagram of a display driver integrated circuit of FIG. 3A according to another example embodiment in detail.

In detail, FIG. 4 illustrates a circuit diagram of the gamma block 110*b* of the DDI 100*b* of FIG. 3A and the first source group 131 and the second source group 132 included in the source driver 130. FIG. 4 is only an example circuit diagram illustrating some components of the DDI 100*b*, and the DDI 100*b* according to an example embodiment may include components other than those of FIG. 4. In an example embodiment, components associated with a common voltage VCOM and the input data signal DIN are omitted in FIG. 4 to prevent the drawing from being unnecessarily complicated, and will be more fully described with reference to FIG. 7.

Referring to FIGS. 1, 3A, 3B, and 4, the DDI 100*b* may include the gamma block 110*b*, first to third buffer blocks EX1 to EX3, the first source group 131, and the second source group 132. The gamma block 110*b* may be connected to the first source group 131, and the first buffer block EX1 may be connected between the gamma block 110*b* and the second source group 132. The first source group 131 may be connected between the third buffer block EX3 and the gamma block 110*b*. The second source group 132 may be connected between the first buffer block EX1 and the second buffer block EX2.

The gamma block 110*b* may include gamma voltage amplifiers GA and a resistor string RSTR including a plurality of resistors. The number of gamma voltage amplifiers GA may be equal to the number of gamma voltages VG1 to VGi generated by the gamma block 110*b*. For example, in the case where the input data signal DIN is a 10-bit signal, the number of gamma voltage amplifiers GA may be 1024. Thus, the number of gamma voltage amplifiers GA may also be 1024.

A first input node (or an input end or an input terminal) of the gamma voltage amplifier GA may receive an initial voltage (e.g., VI1). A second input node of the gamma voltage amplifier GA may be connected to an output node of the gamma voltage amplifier GA. The gamma voltage amplifier GA may amplify the received initial voltage to output two intermediate voltages (e.g., Vop and Von of FIG. 5). The gamma voltage amplifier GA may buffer the intermediate voltages to output a gamma voltage (e.g., VG1). An operation of the gamma voltage amplifier GA will be described in detail later.

The resistor string RSTR of the gamma block 110*b* may include the plurality of resistors serially connected. Some of the plurality of resistors may be connected between nodes from which the gamma voltages VG1 to VGi of the gamma voltage amplifiers GA are output. For example, one of the plurality of resistors may be connected between the node from which the first gamma voltage V1 is output and the node from which the second gamma voltage V2 is output. The uppermost end of the resistor string RSTR may be connected to a terminal to which a first voltage VDD is applied. The lowermost end of the resistor string RSTR may be connected to a terminal to which a second voltage VSS is applied. In an example embodiment, a level of the first voltage VDD may be equal to that of the first gamma voltage VG1, and a level of the second voltage VSS may be equal to that of the i-th gamma voltage VGi. In another example embodiment, the second voltage VSS may be a ground voltage.

The first buffer block EX1 may include a plurality of buffers OUT. The buffer OUT may receive the intermediate voltages output from the gamma voltage amplifier GA. For example, a first input of a first buffer of the plurality of buffers OUT may be connected to a node from which the first intermediate voltage of the first gamma voltage amplifier GA is output. A second input of the first buffer may be connected to a node from which the second intermediate voltage of the first gamma voltage amplifier GA is output. The first buffer may buffer the received intermediate voltages and may output a gamma buffer voltage having the same level as the gamma voltage (e.g., VG1) output from the first gamma voltage amplifier GA.

The first buffer block EX1 may further include a resistor string RSTR including a plurality of resistors. Some of the plurality of resistors may be connected between nodes from which the gamma buffer voltages of the buffers OUT are output. For example, one of the plurality of resistors may be connected between the node from which the gamma buffer voltage having the same level as the first gamma voltage VG1 is output and the node from which the gamma buffer voltage having the same level as the second gamma voltage VG2 is output. The buffers OUT of the first buffer block EX1 may adjust or regulate the gamma buffer voltages respectively provided to nodes to which the plurality of resistors of the resistor string RSTR in the first buffer block EX1 are connected.

The first source group 131 may include (k+1)-th to n-th source channels respectively connected to (k+1)-th to n-th source lines Sk+1 to Sn. Each of the source channels may include a source amplifier and a decoder whose operations are similar to those of the source amplifier SA and the decoder DEC of FIG. 3B. For example, the n-th source channel may include an n-th decoder DECn and an n-th source amplifier. As in the decoder DEC of FIG. 3B, the n-th decoder DECn may select one of the plurality of gamma voltages VG1 to VGi based on data provided from the logic block 140. The n-th decoder DECn may provide the selected voltage to the n-th source amplifier.

The n-th source amplifier may output the received voltage to the n-th source channel connected to the n-th source amplifier. A first input node of the n-th source amplifier may be connected to the n-th decoder DECn. A second input node of the n-th source amplifier may be connected to an output node of the n-th source amplifier. For example, the n-th source amplifier receiving the selected voltage from the n-th decoder DECn may buffer and output the received voltage to the n-th source channel. A source amplifier may be also referred to as a "source buffer".

The second source group 132 may include first to k-th source channels. Like the source channels of the first source group 131, each of the first to k-th source channels may include a source amplifier and a decoder. For example, the first source channel may include a first decoder DEC1 and a first source amplifier connected to the first source line S1.

The second buffer block EX2 may include a resistor string RSTR, including a plurality of resistors, and buffers OUT. The resistor string RSTR of the second buffer block EX2 may be connected between the first source channel of the second source group 132 and the buffers OUT.

A structure and an operation of the buffers OUT included in the second buffer block EX2 may be similar to the structure and the operation of the buffers OUT included in the first buffer block EX1. The buffers OUT of the second buffer block EX2 may adjust or regulate gamma buffer voltages respectively provided to nodes to which the plurality of resistors of the resistor string RSTR in the second buffer block EX2 are connected. The buffers OUT of the second buffer block EX2 may provide gamma buffer voltages to source channels distant from the first buffer block EX1 (e.g., to the first to third source channels respectively connected to the first to third source lines S1 to S3). As such, slew rates of source amplifiers in source channels distant from the first buffer block EX1 may be improved.

The resistor strings RSTR respectively included in the first buffer block EX1 and the second buffer block EX2 may supply currents to the second source group 132. As a result, a time taken to recover a gamma buffer line to which a gamma buffer voltage is provided may decrease.

The third buffer block EX3 may include a resistor string RSTR, including a plurality of resistors, and buffers OUT. The resistor string RSTR of the third buffer block EX3 may be connected between the n-th source channel of the first source group 131 and the buffers OUT.

A structure and an operation of the buffers OUT included in the third buffer block EX3 may be similar to the structure and the operation of the buffers OUT included in the first buffer block EX1. The buffers OUT of the third buffer block EX3 may adjust or regulate gamma buffer voltages respectively provided to nodes to which the plurality of resistors of the resistor string RSTR in the third buffer block EX3 are connected.

The buffers OUT of the third buffer block EX3 may provide the gamma buffer voltages to source channels distant from the gamma block 110*b* (e.g., to (n−2)-th to n-th source channels respectively connected to the (n−2)-th to n-th source lines Sn−2 to Sn). As such, slew rates of source amplifiers in source channels distant from the gamma block 110*b* may be improved.

As in the resistor strings RSTR respectively included in the first buffer block EX1 and the second buffer block EX2, the resistor strings RSTR respectively included in the gamma block 110*b* and the third buffer block EX3 may supply currents to the first source group 131. As a result, a time taken to recover gamma lines to which the gamma voltages VG1 to VGi are provided may decrease.

Figure 5:
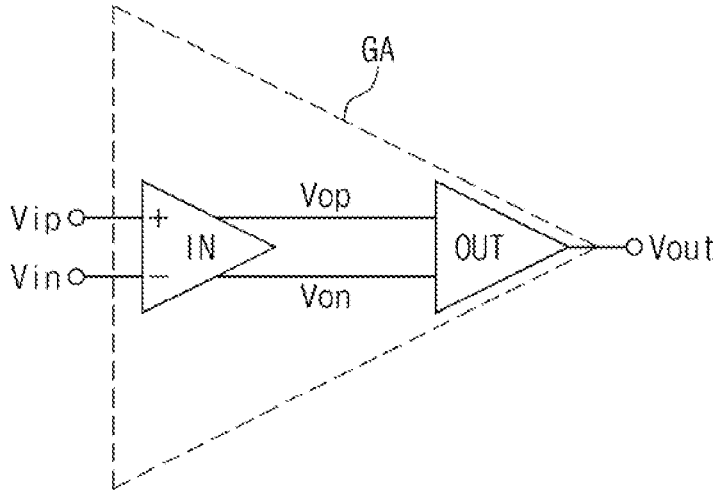
FIG. 5 illustrates a block diagram of a gamma voltage amplifier of FIG. 4.
Figure 6:
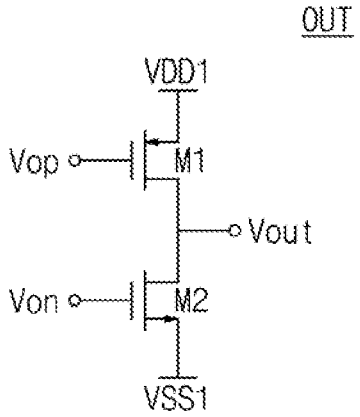
FIG. 6 illustrates a circuit diagram of a buffer of FIG. 5.

FIG. 5 illustrates a block diagram of a gamma voltage amplifier of FIG. 4. FIG. 6 illustrates a circuit diagram of a buffer of FIG. 5.

Referring to FIGS. 4 to 6, the gamma voltage amplifier GA of the gamma block 110*b* may include an input amplifier IN and a buffer OUT.

A first input node of the input amplifier IN may receive a first input voltage Vip. A second input node of the input amplifier IN may receive a second input voltage Vin. The input amplifier IN may amplify at least one of the first and second input voltages Vip and Vin to output the first intermediate voltage Vop and the second intermediate voltage Von to the buffer OUT. The buffer OUT may amplify or buffer the first and second intermediate voltages Vop and Von to output a voltage Vout. The buffer OUT may be also referred to as an "output amplifier".

In an example embodiment, the buffer OUT may be implemented in a push-pull structure. The buffer OUT may include first and second transistors M1 and M2. The first transistor M1 may be a PMOS transistor, and the second transistor M2 may be an NMOS transistor.

A first driving voltage VDD1 may be applied to a first terminal (e.g., a source) of the first transistor M1. The first intermediate voltage Vop may be applied to a second terminal (e.g., a gate) of the first transistor M1. A third terminal (e.g., a drain) of the transistor M1 may be connected to a first terminal (e.g., a drain) of the second transistor M2.

The second intermediate voltage Von may be applied to a second terminal (e.g., a gate) of the second transistor M2. A second driving voltage VSS1 may be applied to a third terminal (e.g., a source) of the second transistor M2. An output node of the buffer OUT may be a node to which the first transistor M1 and the second transistor M2 are connected.

In an example embodiment, a level of the first driving voltage VDD1 may be equal to the level of the first voltage VDD. A level of the second driving voltage VSS1 may be equal to the level of the second voltage VSS.

The buffer OUT may output voltages of different levels based on the levels of the first and second intermediate voltages Vop and Von. For example, the level of the first intermediate voltage Vop may be equal to or greater than a level of a threshold voltage enough to turn on the first transistor M1, and the level of the second intermediate voltage Von may be smaller than a level of a threshold voltage enough to turn on the second transistor M2. In this case, the buffer OUT may output a voltage having the same level as the first driving voltage VDD1.

For another example, the level of the first intermediate voltage Vop may be smaller than the level of the threshold voltage enough to turn on the first transistor M1, and the level of the second intermediate voltage Von may be equal to or greater than the level of the threshold voltage enough to turn on the second transistor M2. In this case, the buffer OUT may output a voltage having the same level as the second driving voltage VSS1.

The gamma voltage amplifier GA may adjust a level of a voltage output from the buffer OUT by adjusting levels of input voltages of the buffer OUT. For example, the gamma voltage amplifier GA may control a timing when the first driving voltage VDD1 or the second driving voltage VSS1 is output from the buffer OUT by adjusting levels of the first intermediate voltage Vop and the second intermediate voltage Von output from the input amplifier IN. As such, the level of the voltage output from the buffer OUT may be adjusted between the level of the first driving voltage VDD1 and the level of the second driving voltage VSS1.

The level of the first driving voltage VDD1 may be higher than levels of the first to i-th gamma voltages VG1 to VGi. The level of the second driving voltage VSS1 may be lower than the levels of the first to i-th gamma voltages VG1 to VGi. The buffer OUT may in turn output the first driving voltage VDD1 and the second driving voltage VSS1. As such, a time taken for the level of the voltage output from the gamma voltage amplifier GA to reach a level of a voltage intended to be output from the gamma voltage amplifier GA may decrease. Thus, a gain of the gamma voltage amplifier GA may be improved.

In an example embodiment, in the case of a first gamma voltage amplifier GA outputting the first gamma voltage VG1, the first input voltage Vip may be a first initial voltage VI1. An input node of the buffer OUT, through which the second input voltage Vin is received, may be connected to the output node of the buffer OUT. In this case, the buffer OUT may output the voltage Vout having the same level as the first gamma voltage VG1, based on the first and second intermediate voltages Vop and Von.

Figure 7:
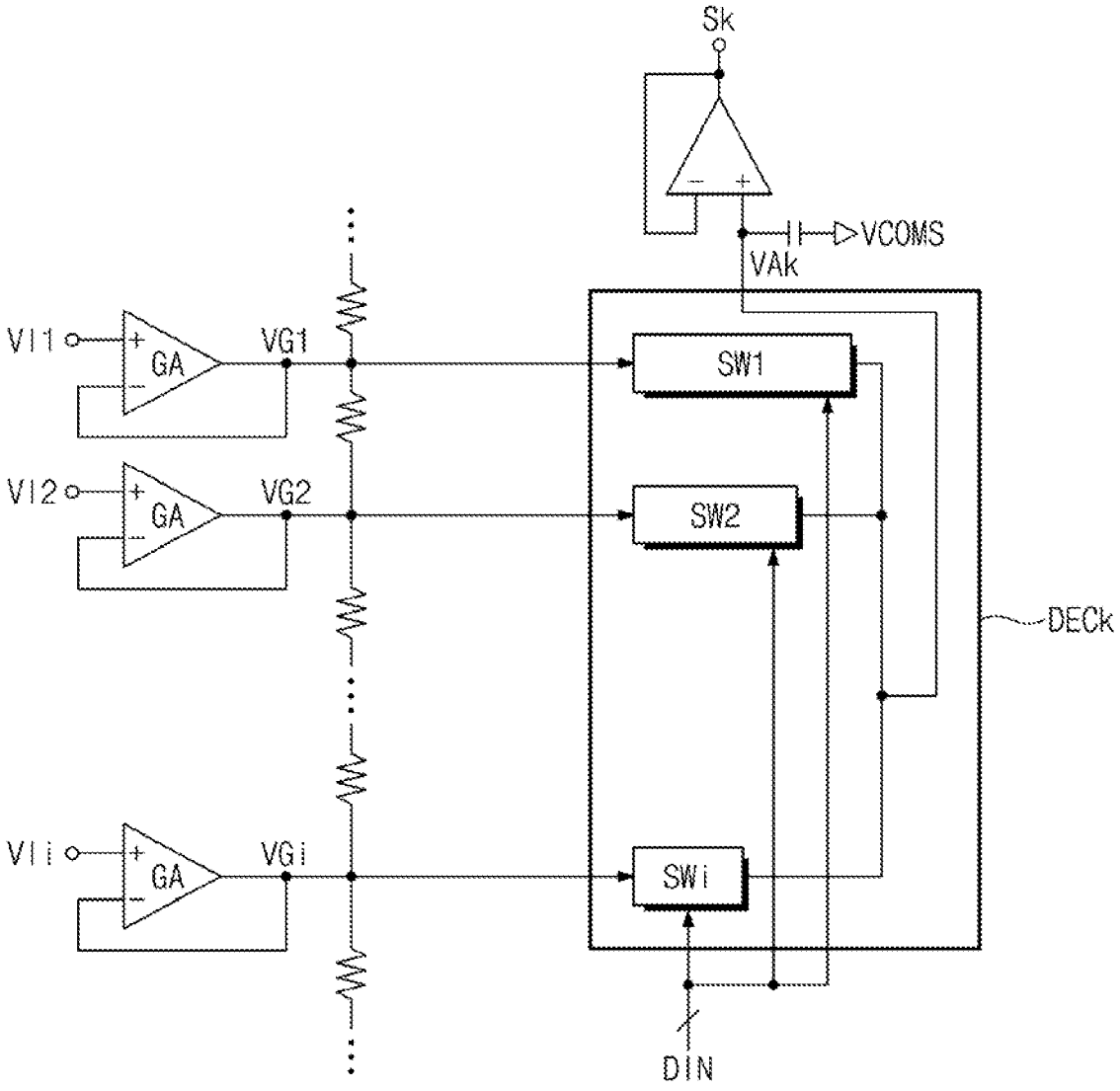
FIG. 7 illustrates a circuit diagram of a source decoder of FIG. 4 according to an example embodiment in detail.

FIG. 7 illustrates a circuit diagram of a source decoder of FIG. 4 according to an example embodiment in detail.

Referring to FIGS. 3B, 4, and 7, a k-th source decoder DECk connected to a k-th source channel Sk may include first to i-th switches SW1 to SWi. A structure and an operation of the remaining decoders (e.g., DEC1) may be similar to a structure and an operation of the k-th source decoder DECk. FIG. 7 shows how outputs of the gamma voltage amplifiers GA are supplied to the k-th source decoder DECk. However, as well as outputs of the gamma voltage amplifiers GA, voltages between resistors connected between the gamma voltage amplifiers GA may be supplied to the k-th source decoder DECk.

The first to i-th switches SW1 to SWi may receive the first to i-th gamma voltages VG1 to VGi. The k-th source decoder DECk may receive the input data signal DIN from the logic block 140. The k-th source decoder DECk may control the first to i-th switches SW1 to SWi based on the input data signal DIN. As such, the k-th source decoder DECk may output a k-th selection voltage VAk of the first to i-th gamma voltages VG1 to VGi to a k-th source amplifier.

For example, based on the input data signal DIN, only one of the first to i-th switches SW1 to SWi may be turned on, and the remaining switches may be turned off. As such, a gamma voltage corresponding to the input data signal DIN, that is, the k-th selection voltage VAk, may be output to the k-th source amplifier.

The k-th source amplifier may amplify the k-th selection voltage VAk thus received. A parasitic capacitance may be present between a node through which the k-th selection voltage VAk is input to the k-th source amplifier and a node to which a source common voltage VCOMS is applied.

In an example embodiment, the k-th source decoder DECk may be implemented with transistors, the number of which is equal to or more than the number of bits of the input data signal DIN. For example, in the case where the number of bits of the input data signal DIN is 10, the k-th source decoder DECk may include at least $2^{10}$ transistors.

Bits of the input data signal DIN may be respectively applied to gates of transistors included in the first to i-th switches SW1 to SWi. As such, when one bit of the input data signal DIN has a value of "1", a transistor to which the corresponding bit is applied may be turned on. In contrast, when one bit of the input data signal DIN has a value of "0", a transistor to which the corresponding bit is applied may be turned off. Operations of the transistors included in the first to i-th switches SW1 to SWi may be controlled based on the input data signal DIN. As a result, only one of the first to i-th switches SW1 to SWi may be turned on based on the input data signal DIN.

The implementation of the first to i-th switches SW1 to SWi may be varied relative to the above description. For example, the first to i-th switches SW1 to SWi may be implemented with a combination of various components capable of performing a switching operation.

FIGS. 8 to 11 are circuit diagrams illustrating a portion of a display driver integrated circuit of FIG. 1 according to different example embodiments in detail.

In detail, FIGS. 8 to 11 illustrate circuit diagrams of the gamma block 110*b* of the DDI 100*b* of FIG. 3A and the first source group 131 and the second source group 132 included in the source driver 130. Differences between FIG. 4 and FIGS. 8 to 11 will be mainly described with reference to FIGS. 1, 3A, 3B, 4, and 8 to 11.

Figure 8:
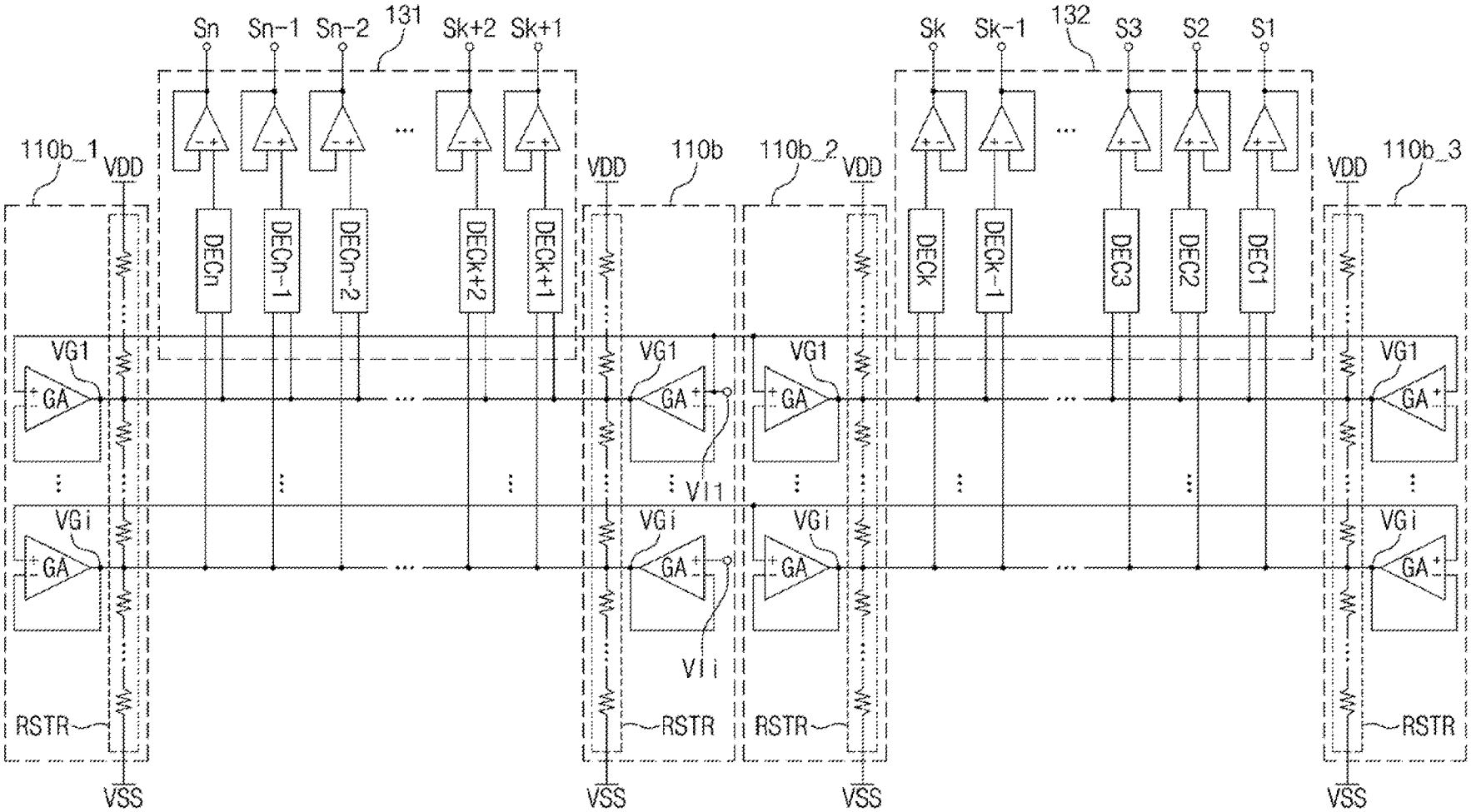
FIG. 8 is a circuit diagram illustrating a portion of a display driver integrated circuit of FIG. 1 according to another example embodiment in detail.

Referring to FIGS. 4 and 8, the DDI 100*b* may include first to third gamma blocks 110*b*_1 to 110*b*_3 instead of the first to third buffer blocks EX1 to EX3. The first gamma block 110*b*_1 may be connected to the n-th source channel instead of the third buffer block EX3. The second gamma block 110*b*_2 may be connected to the k-th source channel instead of the first buffer block EX1. The third gamma block 110*b*_3 may be connected to the first source channel instead of the second buffer block EX2. Each of the first to third gamma blocks 110*b*_1 to 110*b*_3 may include a resistor string RSTR and "i" gamma voltage amplifiers GA.

Thus, the DDI 100*b* according to the circuit diagram of FIG. 8 may further include the first to third gamma blocks 110*b*_1 to 110*b*_3. As such, the area and the power consumption of the DDI 100*b* may decrease compared to the DDI 100*b* of FIG. 4. A load seen from the gamma block 110*b*_1/110*b*_2/110*b*_3 to source channels may be smaller than a load of the gamma block 110*b* of FIG. 4. As such, a slew rate of the source amplifier SA of FIG. 3B may be improved.

Figure 9:
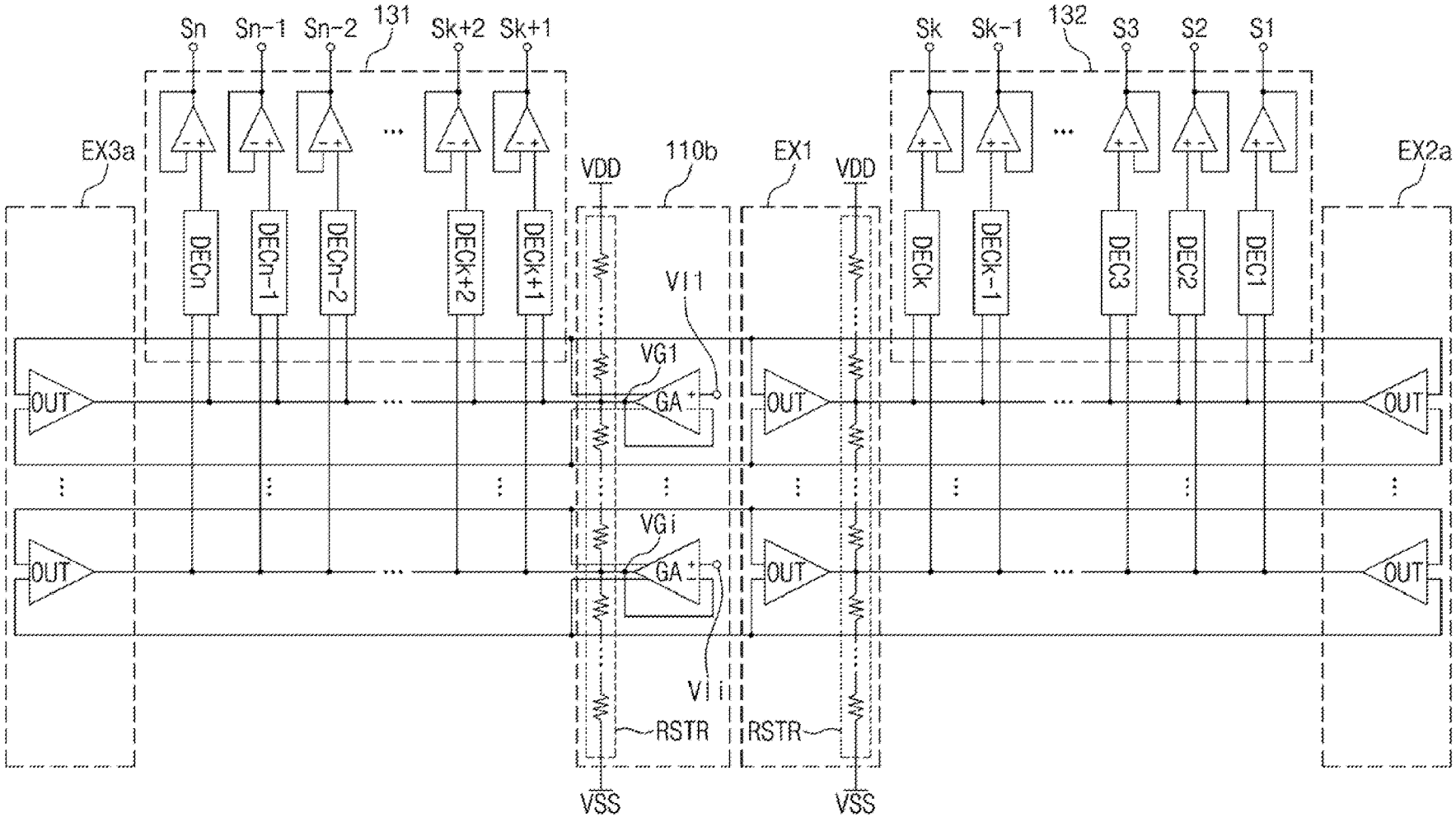
FIG. 9 is a circuit diagram illustrating a portion of a display driver integrated circuit of FIG. 1 according to another example embodiment in detail.

Referring to FIGS. 4 and 9, the DDI 100*b* may include second and third gamma blocks EX2*a* to EX3*a* instead of the second and third buffer blocks EX2 and EX3. The second buffer block EX2*a* may be connected to the first source channel instead of the second buffer block EX2. The third buffer block EX3*a* may be connected to the n-th source channel instead of the third buffer block EX3. Unlike the second and third buffer blocks EX2 and EX3, each of the second and third buffer blocks EX2*a* and EX3*a* may not include the resistor string RSTR.

In the case where the second and third buffer blocks EX2*a* and EX3*a* replace the second and third buffer blocks EX2 and EX3, gamma buffer voltages to be provided to the n-th source channel and the first source channel to which the second buffer block EX2*a* and the third buffer block EX3*a* are respectively connected may be adjusted by the second buffer block EX2*a* and the third buffer block EX3*a*. The area of the circuit of FIG. 9 may be smaller than that of FIG. 4.

Figure 10:
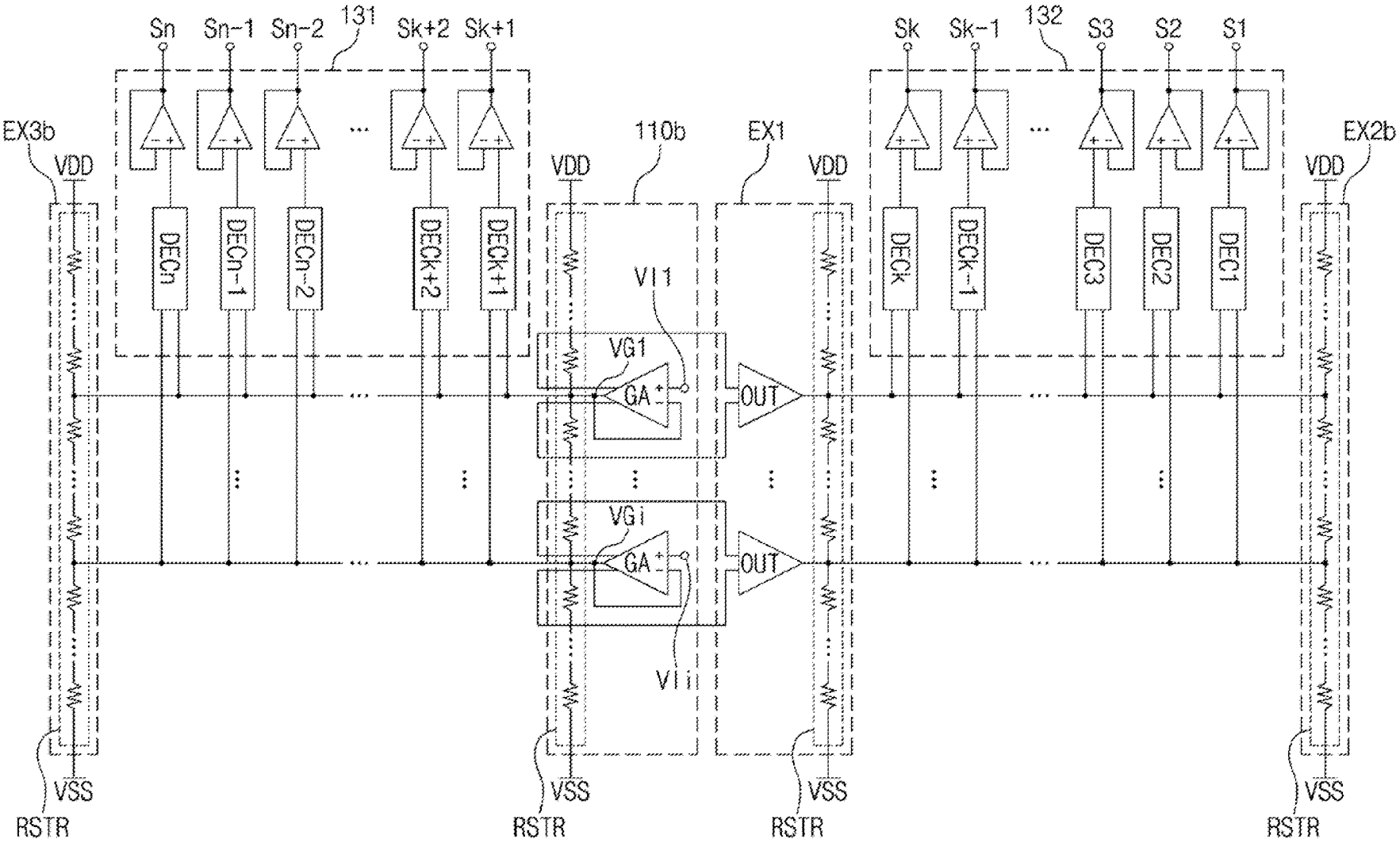
FIG. 10 is a circuit diagram illustrating a portion of a display driver integrated circuit of FIG. 1 according to another example embodiment in detail.

Referring to FIGS. 4 and 10, the DDI 100*b* may include second and third buffer blocks EX2*b* to EX3*b* instead of the second and third buffer blocks EX2 and EX3. The second buffer block EX2*b* may be connected to the first source channel instead of the second buffer block EX2. The third buffer block EX3*b* may be connected to the n-th source channel instead of the third buffer block EX3. Unlike the second and third buffer blocks EX2 and EX3, each of the second and third buffer blocks EX2*b* and EX3*b* may not include the buffers OUT. The area of the circuit of FIG. 10 may be smaller than that of FIG. 4.

Figure 11:
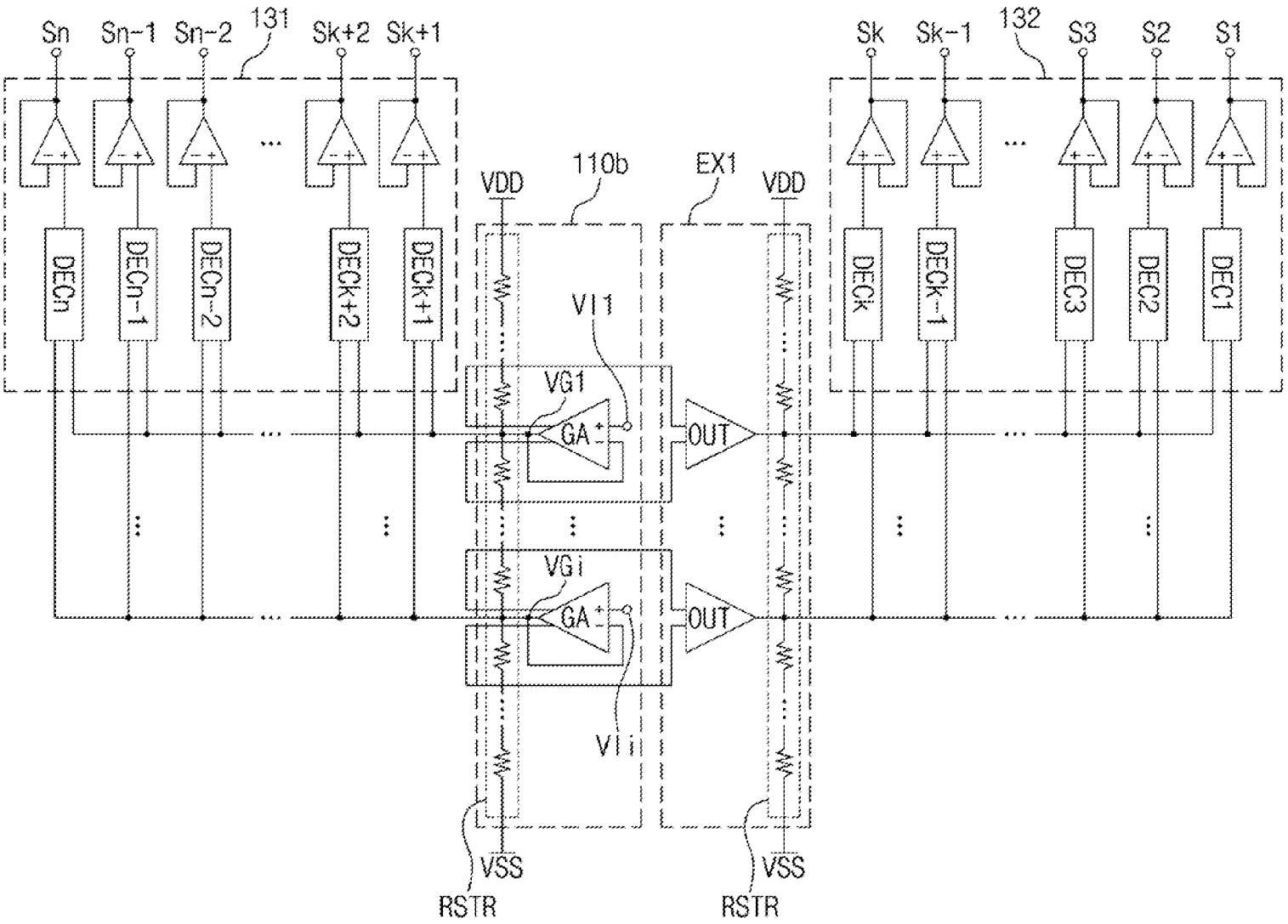
FIG. 11 is a circuit diagram illustrating a portion of a display driver integrated circuit of FIG. 1 according to another example embodiment in detail.

Referring to FIGS. 4 and 11, the DDI 100*b* may include only the gamma block 110*b* and the first buffer block EX1, and may not include the second and third buffer blocks EX2 and EX3. As such, the resistor string RSTR may be disposed only in the middle of the DDI 100*b*. The resistor string RSTR of the gamma block 110*b* may supply currents to the (k+1)-th to n-th source channels. The resistor string RSTR of the first buffer block EX1 may supply currents to the first to k-th source channels S1 to Sk. The area of the circuit of FIG. 11 may be smaller than that of FIG. 4. Also, the power consumption of the circuit of FIG. 11 may be smaller than that of FIG. 4.

Figure 12A:
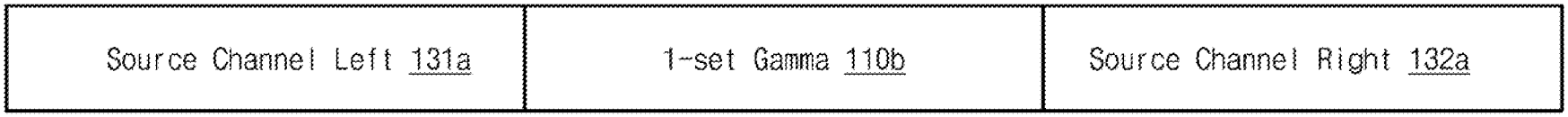
FIG. 12A illustrates a portion of a block diagram of a display driver integrated circuit of FIG. 1 according to different example embodiments in detail.
Figure 12B:
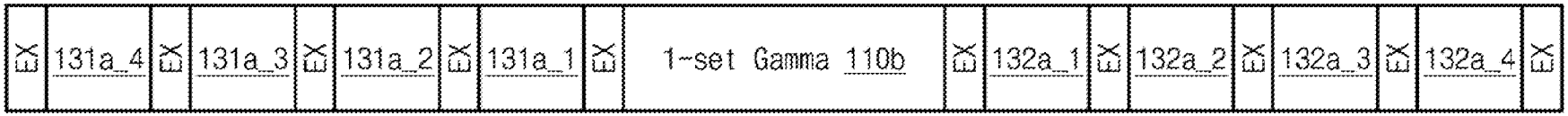
FIG. 12B illustrates a portion of a block diagram of a display driver integrated circuit of FIG. 1 according to different example embodiments in detail.
Figure 12C:
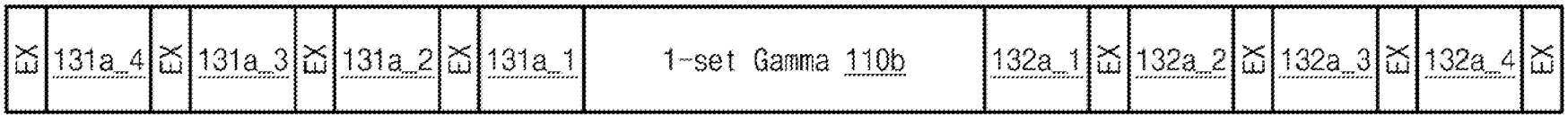
FIG. 12C illustrates a portion of a block diagram of a display driver integrated circuit of FIG. 1 according to different example embodiments in detail.

FIGS. 12A to 12C are block diagrams illustrating a portion of a display driver integrated circuit of FIG. 1 according to different example embodiments in detail.

In detail, according to different example embodiments, FIGS. 12A to 12C illustrate block diagrams of a first gamma block 110*b*, a first source group 131*a*, and a second source group 132*a* of the DDI 100*b* of FIG. 3A. FIGS. 12A to 12C will be described with reference to FIGS. 3A, 3B, and 4.

Referring to FIG. 12A, the gamma block 110*b* may be disposed in the middle of the DDI 100*b*. The first source group 131*a* may be disposed adjacent to a left side of the gamma block 110*b*. The second source group 132*a* may be disposed adjacent to a right side of the gamma block 110*b*.

In an example embodiment, source channels included in the source driver 130 may be equally divided into the first source group 131*a* and the second source group 132*a*. Thus, the number of source channels included in the first source group 131*a* may be equal to the number of source channels included in the second source group 132*a*.

Referring to FIG. 12B, buffer blocks EX may be respectively disposed on one side of the gamma block 110*b* in a first direction and on another side of the gamma block 110*b* in a direction facing away from the first direction. For example, the buffer blocks EX may be disposed on the left and the right of the gamma block 110*b*, respectively. The buffer blocks EX may be respectively disposed between the gamma block 110*b* and a first portion 131*a*_1 of the first source group 131*a*, and between the gamma block 110*b* and a first portion 132*a*_1 of the second source group 132*a*. For example, in the case where a long side of the gamma block 110*b* is sufficiently large, the buffer blocks EX disposed on opposite sides of the gamma block 110*b* may make the slew rate of the source amplifiers SA of source channels better. In contrast, referring to FIG. 12C, the buffer blocks EX may not be interposed between the gamma block 110*b* and the first portion 131*a*_1 of the first source group 131*a* and between the gamma block 110*b* and the first portion 132*a*_1 of the second source group 132*a*.

In an example embodiment, as illustrated, the buffer block EX may be interposed between source channels of the first source group 131*a*. The buffer block EX may be interposed between the first portion 131*a*_1 of the first source group 131*a* and a second portion 131*a*_2 of the first source group 131*a*. The buffer block EX may be interposed between the second portion 131*a*_2 of the first source group 131*a* and a third portion 131*a*_3 of the first source group 131*a*. The buffer block EX may be interposed between the third portion 131*a*_3 of the first source group 131*a* and a fourth portion 131*a*_4 of the first source group 131*a*. The buffer block EX may be disposed on the left of the fourth portion 131*a*_4 of the first source group 131*a*. Thus, the buffer block EX may be disposed at a periphery of the DDI 100*b*.

The number of buffer blocks EX that are disposed (or interposed) may be varied from the illustrated embodiment. For example, the buffer block EX may be disposed in the first portion 131*a*_1 of the first source group 131*a*. For another example, unlike the illustrated example, the buffer block EX may not be interposed between the second portion 131*a*_2 of the first source group 131*a* and the third portion 131*a*_3 of the first source group 131*a*.

As in the above description, buffer block EX may be interposed between source channels of the second source group 132*a*.

The buffer block EX may include at least one of a buffer module including the plurality of buffers OUT and a resistor string including a plurality of resistors. Thus, the buffer block EX may be implemented like the first buffer block EX1 of FIG. 4, the second buffer block EX2*a* of FIG. 9, or the second buffer block EX2*b* of FIG. 10.

The source channels of the first source group 131*a* may be distributed into the first to fourth portions 131*a*_1 to 131*a*_4 of the first source group 131*a*. In an example embodiment, the source channels of the first source group 131*a* may be distributed into the first to fourth portions 131*a*_1 to 131*a*_4 of the first source group 131*a* so as to be disposed at a regular interval.

For example, in the case where the first source group 131*a* includes 2000 source channels, each of the first to fourth portions 131*a*_1 to 131*a*_4 of the first source group 131*a* may include 500 source channels. Thus, the buffer block EX may be interposed between source channel groups each including 500 source channels. For another example, in the case where the first source group 131*a* includes 4000 source channels, each of the first to fourth portions 131*a*_1 to 131*a*_4 of the first source group 131*a* may include 1000 source channels. Thus, the buffer block EX may be interposed between source channel groups each including 1000 source channels.

The number of source channels belonging to each of source channel groups between which the buffer block EX is interposed may be varied relative to the above example. The number of source channels between two buffer blocks EX may increase or decrease based on a parasitic resistance amount and a parasitic capacitance amount of a gamma line between the gamma block 110*b* and source channels. For example, as a parasitic resistance amount and a parasitic capacitance amount of a gamma line, that is, a size of a load seen from the gamma block 110*b* to each of the first and second source groups 131*a* and 132*a* increases, an interval at which the buffer block EX is disposed between source line groups may be decreased (or the number of source channels interposed between two buffer blocks EX may be decreased).

The buffer blocks EX may be disposed at any locations of the first and second source groups 131*a* and 131*b*, based on a load seen from the gamma block 110*b* to each of the first and second source groups 131*a* and 132*a*. As such, the number of source channels interposed between the buffer blocks EX may be uniform or may vary.

A slew rate of the source amplifier SA may be determined based on a resistance seen from an input node of the source amplifier SA to the gamma block 110*b* and a load seen from an output node of the source amplifier SA to the source lines S1 to Sn or the display panel 2. A product of a resistance and a capacitance seen from the input node of the source amplifier SA to the gamma block 110*b* may be determined based on a parasitic capacitance and a parasitic resistance of a gamma line, a resistance of the switches SW1 to SWi in the source decoder DEC to which the source amplifier SA is connected, a parasitic capacitance of one input node of the source amplifier SA, etc. Thus, as a load seen from the gamma block 110*b* to each of the first and second source groups 131*a* and 132*a* increases, a slew rate of the source amplifier SA may decrease.

According to an example embodiment, one or more buffer blocks EX may be interposed between source channel groups. The buffer block EX may provide gamma buffer voltages to source channels relatively distant from the gamma block 110*b*. As such, as a load seen from the gamma block 110*b* to each of the first and second source groups 131*a* and 132*a* may decrease. As a result, a slew rate of the source amplifier SA may be improved. Also, a speed at which gamma lines for providing the plurality of gamma voltages VG1 to VGi and gamma buffer lines for providing a plurality of gamma buffer voltages are recovered may be improved.

According to an example embodiment, a display driver integrated circuit may include a buffer block including a resistor string interposed between source channels and a plurality of buffers. As such, a load between one gamma block and source channels may decrease. Accordingly, a display driver integrated circuit capable of improving a slew rate and a speed at which gamma lines for providing gamma voltages from a gamma block to source channels are recovered and an electronic device including the same may be provided.

By way of summation and review, as a load between a gamma voltage generator and each source channel becomes larger, a slew rate of the source amplifier may decrease. As such, as the number of channels connected to one gamma block increases, the slew rate of the source amplifier may decrease. Thus, a speed at which a voltage is input to an input terminal of the source amplifier may decrease.

As described above, embodiments may provide a display driver integrated circuit with an improved slew rate and an electronic device including the same.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An electronic device, comprising:

a first source group and a second source group each including a plurality of source channels;

a gamma block configured to receive first to i-th initial voltages wherein i is an integer of 1 or more, to output first to i-th pairs of intermediate voltages by amplifying the first to i-th initial voltages respectively, and to output first to i-th gamma voltages to the first source group by buffering the first to i-th pairs of intermediate voltages respectively; and a first buffer block configured to receive the first to i-th pairs of intermediate voltages from the gamma block and to buffer the first to i-th pairs of intermediate voltages so as to be output to the second source group, wherein the gamma block includes a first resistor string including a plurality of resistors connected between nodes from which the first to i-th gamma voltages are output.

2. The electronic device as claimed in claim 1, wherein the gamma block includes first to i-th gamma voltage amplifiers, wherein the first to i-th gamma voltage amplifiers amplify the first to i-th initial voltages, respectively, and wherein nodes of the first to i-th gamma voltage amplifiers from which the first to i-th gamma voltages are respectively outputs are connected to the first resistor string.

3. The electronic device as claimed in claim 2, wherein the first gamma voltage amplifier includes:

an operational amplifier including a first input node receiving the first initial voltage, and configured to amplify the first initial voltage received through the first input node and to output the first pair of intermediate voltages; and a buffer configured to buffer the first pair of intermediate voltages received from the operational amplifier and to output the first gamma voltage to the first source group, and wherein a second input node of the operational amplifier is connected to an output node of the buffer.

4. The electronic device as claimed in claim 3, wherein the buffer includes a first transistor and a second transistor, wherein a first terminal of the first transistor is connected to a first driving voltage, a second terminal of the first transistor is connected to a node from which a first intermediate voltage of the first pair of intermediate voltages of the operational amplifier is output, and a third terminal of the first transistor is connected to a first terminal of the second transistor and the output node of the buffer, and wherein a second terminal of the second transistor is connected to a node of the operational amplifier from which a second intermediate voltage of the first pair of intermediate voltages is output, and a third terminal of the second transistor is connected with a second driving voltage.

5. The electronic device as claimed in claim 3, wherein the first buffer block includes a second resistor string including a plurality of resistors serially connected, and first to i-th output amplifiers, wherein the first to i-th output amplifiers respectively receive the first to i-th pairs of intermediate voltages from the gamma block and buffer the first to i-th pairs of intermediate voltages to respectively output first to i-th gamma buffer voltages to the second source group, and wherein the plurality of resistors are connected between nodes from which the first to i-th gamma buffer voltages of the first to i-th output amplifiers are respectively output.

6. The electronic device as claimed in claim 5, wherein each of the first to i-th output amplifiers are implemented to be identical to the buffer of the first gamma voltage amplifier.

7. The electronic device as claimed in claim 1, wherein a first source channel of the plurality of source channels includes:

a first source decoder configured to receive the first to i-th gamma voltages, to select a signal voltage among the first to i-th gamma voltages, and to output the signal voltage; and a first source amplifier configured to receive the signal voltage from the first source decoder, to buffer the signal voltage, and to output the buffered signal voltage to a first source line.

8. The electronic device as claimed in claim 7, wherein the first source decoder selects two or more signal voltages among the first to i-th gamma voltages in a time-division manner, and wherein the first source amplifier is configured to receive the two or more signal voltages in the time-division manner and to output the two or more signal voltages to two or more source lines, respectively.

9. The electronic device as claimed in claim 1, further comprising:

a second buffer block connected to the second source group, and configured to receive the first to i-th pairs of intermediate voltages from the gamma block and to buffer the first to i-th pairs of intermediate voltages thus received so as to be output to the second source group; and a third buffer block connected with the first source group, and configured to receive the first to i-th pairs of intermediate voltages from the gamma block and to buffer the first to i-th pairs of intermediate voltages thus received so as to be output to the first source group, wherein the second buffer block includes:

"i" buffers configured to receive the first to i-th pairs of intermediate voltages respectively and to buffer the first to i-th pairs of intermediate voltages so as to be output to the second source group, respectively; and a plurality of resistors connected between output nodes of the plurality of buffers.

10. The electronic device as claimed in claim 9, further comprising:

a third source group including a plurality of third source channels; and a fourth buffer block configured to receive the first to i-th pairs of intermediate voltages from the gamma block, and to buffer the first to i-th pairs of intermediate voltages thus received so as to be output to the third source group.

11. An electronic device, comprising:

a display panel including a plurality of pixels; and a display driver integrated circuit, wherein the display driver integrated circuit includes:

a gate driver connected with the plurality of pixels through first to m-th gate lines, and configured to activate the first to m-th gate lines;

a source driver connected to the plurality of pixels through first to n-th source lines, and configured to provide data signals to the first to n-th source lines respectively; and a gamma voltage generator configured to generate first to i-th gamma voltages wherein i is an integer more than 1, and to provide the first to i-th gamma voltages to the source driver, wherein each of the data signals is based on the first to i-th gamma voltages, and wherein the gamma voltage generator includes:

first to i-th gamma voltage amplifiers configured to respectively receive first to i-th initial voltages, to respectively output first to i-th pairs of intermediate voltages by respectively amplifying the first to i-th initial voltages, and to respectively output the first to i-th gamma voltages by respectively buffering the first to i-th pairs of intermediate voltages; and a first resistor string including a plurality of resistors connected between nodes of the first to i-th gamma voltage amplifiers from which the first to i-th gamma voltages are output.

12. The electronic device as claimed in claim 11, wherein the plurality of pixels include first to third pixels displaying different colors, and wherein the source driver provides a first data signal among the data signals to one of the first to third pixels in a time-division manner.

13. The electronic device as claimed in claim 11, wherein the display driver integrated circuit further includes:

a first buffer block connected to outputs of the gamma voltage generator; and first to k-th source channels, wherein k is a positive integer less than n, connected between the first resistor string and the first buffer block, wherein the first to k-th source channels are respectively connected to the first to k-th source lines, wherein the first source channel is connected between the first resistor string and the second source channel, the second to k-th source channels are respectively connected to the first to (k−1)-th source channels, and the k-th source channel is connected between the (k−1)-th source channel and the first buffer block, and wherein the first buffer block includes:

"i" buffers configured to respectively buffer the first to i-th pairs of intermediate voltages received from the first to i-th gamma voltage amplifiers, and to respectively output first to i-th first gamma buffer voltages, levels of which are respectively equal to levels of the first to i-th gamma voltages; and a second resistor string including a plurality of resistors connected between output nodes of the "i" buffers, and connected between the "i" buffers and the (k−1)-th source channel.

14. The electronic device as claimed in claim 13, further comprising:

a second buffer block including a third resistor string including a plurality of resistors and connected to the outputs of the gamma voltage generator;

a third buffer block including a fourth resistor string including a plurality of resistors and connected to the outputs of the gamma voltage generator; and (k+1)-th to n-th source channels connected between the third resistor string of the second buffer block and the third buffer block, and respectively connected to the (k+1)-th to n-th source lines.

15. The electronic device as claimed in claim 14, wherein the second buffer block is configured to receive the first to i-th pairs of intermediate voltages from the first to i-th gamma voltage amplifiers, to buffer the first to i-th pairs of intermediate voltages thus received, and to output first to i-th second gamma buffer voltages, levels of which are respectively equal to levels of the first to i-th gamma voltages, to the (k+1)-th to n-th source channels.

16. The electronic device as claimed in claim 13, wherein the "n" is an even number, and the "k" is a value obtained by dividing the "n" by 2.

17. The electronic device as claimed in claim 11, wherein the first to i-th gamma voltage amplifiers respectively include:

first to i-th amplifiers configured to respectively receive the first to i-th initial voltages, to respectively amplify the first to i-th initial voltages, and to respectively output the first to i-th pairs of intermediate voltages; and first to i-th buffers configured to buffer the first to i-th pairs of intermediate voltages, respectively.

18. An electronic device, comprising:

a gamma block configured to generate gamma voltages;

first source channels disposed on one side of the gamma block in a first direction, and configured to receive the gamma voltages and to output first gamma voltages selected from the gamma voltages to first source lines;

second source channels disposed on another side of the gamma block in a second direction facing away from the first direction, and configured to receive the gamma voltages and to output second gamma voltages selected from the gamma voltages to second source lines;

a first buffer block disposed on one side of the first source channels in the first direction, and configured to supply first buffering voltages corresponding to the gamma voltages to the first source channels; and a second buffer block disposed on one side of the second source channels in the second direction, and configured to supply second buffering voltages corresponding to the gamma voltages to the second source channels.

19. The electronic device as claimed in claim 18, further comprising:

a third buffer block connected between the first source channels, and configured to supply third buffering voltages corresponding to the gamma voltages to a part of the first source channels, wherein the first buffering voltages are supplied to remaining first source channels other than the part of the first source channels.

20. The electronic device as claimed in claim 19, wherein a number of source channels to which the third buffering voltages are supplied, from among the first source channels, is equal to a number of source channels to which the first buffering voltages are supplied, from among the first source channels.

* * * * *